US009297388B2

(12) United States Patent
Kato et al.

(10) Patent No.: US 9,297,388 B2
(45) Date of Patent: Mar. 29, 2016

(54) SHAFT SEAL DEVICE AND PUMP APPARATUS USING THE SAME

(71) Applicants: ADVICS CO., LTD., Kariya-shi (JP); DENSO CORPORATION, Kariya-shi (JP)

(72) Inventors: Daishi Kato, Nagoya (JP); Kunihito Ando, Okazaki (JP); Yuki Nakamura, Kariya-shi (JP); Takahiro Naganuma, Kariya-shi (JP); Tomoaki Kawabata, Takahama (JP)

(73) Assignees: ADVICS CO., LTD., Kariya-Shi, Aichi-Ken (JP); DENSO CORPORATION, Kariya-Shi, Aichi-Ken (JP)

( * ) Notice: Subject to any disclaimer, the term of this patent is extended or adjusted under 35 U.S.C. 154(b) by 210 days.

(21) Appl. No.: 13/628,544

(22) Filed: Sep. 27, 2012

(65) Prior Publication Data

US 2013/0075979 A1 Mar. 28, 2013

(30) Foreign Application Priority Data

Sep. 27, 2011 (JP) ..... 2011-210348

(51) Int. Cl.

| | |
|---|---|
| ***F04D 29/12*** | (2006.01) |
| ***F04C 15/00*** | (2006.01) |
| ***F04D 29/10*** | (2006.01) |
| ***F04C 2/10*** | (2006.01) |
| ***F04C 11/00*** | (2006.01) |

(52) U.S. Cl.

CPC ..... *F04D 29/108* (2013.01); *F04C 2/102* (2013.01); *F04C 11/001* (2013.01); *F04C 15/0038* (2013.01); *F04D 29/128* (2013.01)

(58) Field of Classification Search

USPC ..... 418/104, 141, 171, 206.6; 277/372; 415/174.3

See application file for complete search history.

(56) References Cited

U.S. PATENT DOCUMENTS 2,809,854 A * 10/1957 McGahan ..... 277/579
3,416,455 A * 12/1968 Pietrucha ..... 415/174.3

(Continued)

FOREIGN PATENT DOCUMENTS

CN 201137700 Y 10/2008
JP 2007-278084 A 10/2007

OTHER PUBLICATIONS

Chinese First Office Action dated Aug. 3, 2015 issued in the corresponding Chinese Patent Application No. 201210366477.2 and English translation (17 pages).

*Primary Examiner* — Jorge Pereiro
*Assistant Examiner* — Paul Thiede
(74) *Attorney, Agent, or Firm* — Buchanan Ingersoll & Rooney PC

(57) ABSTRACT

A shaft seal device includes: a rotary shaft; a seal member that is arranged on an outer periphery of the rotary shaft; a liquid chamber; and a seal member accommodation chamber that accommodates the seal member therein, wherein the liquid chamber and the seal member accommodation chamber is separated by a partition wall, wherein the rotary shaft passes through a shaft hole formed in the partition wall and an outer periphery of the rotary shaft is sealed by the seal member, wherein the partition wall is formed with a through-hole penetrating the partition wall, a hollow member is mounted in the through-hole, a protrusion part of the hollow member protrudes toward the seal member accommodation chamber to engage with the seal member, and wherein the liquid chamber and the seal member accommodation chamber communicate with each other through a hole of the hollow member.

11 Claims, 5 Drawing Sheets

(56) References Cited

U.S. PATENT DOCUMENTS

| | | | | |
|---|---|---|---|---|
| 7,530,647 | B2 | 5/2009 | Yamaguchi et al. | |
| 7,931,454 | B2 | 4/2011 | Yamaguchi et al. | |
| 2002/0141893 | A1* | 10/2002 | Hoshino et al. | 418/104 |
| 2011/0116939 | A1 | 5/2011 | Kawabata et al. | |
| 2011/0116949 | A1 | 5/2011 | Kawabata | |

* cited by examiner

SHAFT SEAL DEVICE AND PUMP APPARATUS USING THE SAME

CROSS-REFERENCE TO RELATED APPLICATION

This application claims priority from Japanese Patent Application No. 2011-210348 filed on Sep. 27, 2011, the entire subject matter of which is incorporated herein by reference.

TECHNICAL FIELD

This disclosure relates to a shaft seal device that seals a gap of an outer periphery of a rotary shaft and a pump apparatus using the same, and more specifically, to a shaft seal device that prevents foreign materials or deteriorated lubricant from remaining to improve lubrication and protection performance of a seal member, and a rotary pump apparatus using the shaft seal to improve durability of a shaft seal part, such as gear pump, vane pump, impeller pump and the like.

BACKGROUND

For example, JP-A-2007-278084 discloses a power-driven pump apparatus that is used for a brake fluid pressure control apparatus.

The pump apparatus disclosed in JP-A-2007-278084 has a well-known internal gear pump having combined an inner rotor (external gear) and an outer rotor (internal gear) and has two sets of pumps that are provided on the same axial line and are driven by the same rotary shaft. Also, a seal member, which seals an outer periphery of a driving rotary shaft to hydraulically partition the two sets of pumps, is provided between the two sets of pumps.

Also, a housing that accommodates the seal member therein is provided with a partition wall that prevents the seal member from moving toward one pump. A bearing is provided between the other pump and the seal member and prevents the seal member from moving toward the other pump. Accordingly, the partition wall is only provided between a seal member accommodation chamber and the one pump, and a rotary shaft for driving a pump passes through a shaft hole that is formed in the partition wall.

In the meantime, an end face of a pump accommodation chamber provided in the housing is formed with a liquid chamber (suction pump or discharge pump) communicating with a chamber (pump chamber) of the pump and the liquid chamber, and the seal member accommodation chamber are separated by the partition wall.

SUMMARY

In the pump apparatus of JP-A-2007-278084, the seal member accommodation chamber is separated by the partition wall from the liquid chamber communicating with the chamber of the one pump. Thereby, the lubricant (brake fluid pumped by the pump) is confined and can be easily remained at a side of the seal member accommodation chamber separated from the liquid chamber. Due to remaining, the lubricant is to be deteriorated and the seal member is to be degenerated, so that the lifetime of the seal member is to be reduced.

If the above concerns are solved, the lubrication and protection performance of a shaft seal part can be improved. Hence, there is room for improvement on the pump apparatus of JP-A-2007-278084.

Also, the remaining of the lubricant is associated with remaining of the foreign materials (abrasion powders of the seal member and the like). Therefore, in view of avoiding the damage of the seal member due to the remaining foreign materials, there is also room for improvement.

This disclosure provides at least a shaft seal device, which seals a gap of an outer periphery of a rotary shaft, capable of effectively preventing foreign materials or deteriorated lubricant from remaining to improve lubrication and protection performance of a seal member, and a rotary pump apparatus capable of improving durability of a shaft seal part by using the improved shaft seal device.

In view of the above, this disclosure improves a shaft seal device that comprise: a rotary shaft; a seal member that is arranged on an outer periphery of the rotary shaft; a liquid chamber that is filled with oil; and a seal member accommodation chamber that accommodates the seal member therein, wherein the liquid chamber and the seal member accommodation chamber is separated by a partition wall, and wherein the rotary shaft passes through a shaft hole formed in the partition wall and an outer periphery of the rotary shaft is sealed by the seal member.

Specifically, in the shaft seal device of this closure, the partition wall is formed with a through-hole penetrating the partition wall, a hollow member is mounted in the through-hole, a protrusion part of the hollow member protrudes toward the seal member accommodation chamber to engage with the seal member, and the liquid chamber and the seal member accommodation chamber communicate with each other through a hole of the hollow member.

Further, above-described shaft seal device is applied to a rotary pump apparatus that comprises a rotary pump that pumps up liquid; a rotary shaft that drives the pump; and a seal member that is arranged on an outer periphery of the rotary shaft; wherein the seal member is accommodated in a seal member accommodation chamber formed at the outer periphery of the rotary shaft, wherein a liquid chamber connected to a chamber of the pump and the seal member accommodation chamber are separated by a partition wall, and wherein the rotary shaft passes through a shaft hole formed in the partition wall.

Specifically, in the rotary pump apparatus of this disclosure, the partition wall is formed with a through-hole penetrating the partition wall, a hollow member is mounted in the through-hole, a protrusion part of the hollow member protrudes toward the seal member accommodation chamber to engage with the seal member, and the liquid chamber and the seal member accommodation chamber communicate with each other through a hole of the hollow member.

In the above-described rotary pump apparatus of this disclosure, two sets of the rotary pumps driven by the rotary shaft may be provided at both sides of the seal member accommodation chamber so that a phase difference of a suction and a discharge between the pumps is 180 degrees, the seal member may be formed to be axially movable in the seal member accommodation chamber, both sides of the seal member accommodation chamber partitioned by the seal member respectively communicates with two of the liquid chambers that is respectively connected to chambers at both side of the pumps, and the partition wall may be arranged at least one of positions between the liquid chamber and the seal member accommodation chamber, and the hollow member is mounted to the partition wall.

In the above-described rotary pump apparatus of this disclosure, the hollow member may be arranged at a position, at which an opening of the hole of the hollow member overlaps with an upper side space of the seal member accommodation chamber in a vertical direction, or the partition wall may be formed with a plurality of the through-holes and then the hollow member may mounted in at least one of the plurality of the through-holes.

In case that both sides of the seal member accommodation chamber partitioned by the seal member and the other side of the liquid chamber and the seal member accommodation chamber communicate with each other through a bearing, etc., as described in JP-A-2007-278084, the hollow member may be mounted to the partition wall arranged at one of the positions between the liquid chamber and the seal member accommodation chamber.

According to the shaft seal device and the pump apparatus using the same of this disclosure, the hollow member penetrates the partition wall that partitions the seal member accommodation chamber and the liquid chambers, and the seal member accommodation chamber and the liquid chambers communicates with each other by the hole of the hollow member. Accordingly, a circulation path of the oil introduced into both chambers is formed between the seal member accommodation chamber and the liquid chambers.

In case that only one hollow member is provided, the circulation path is configured by the hole of the hollow member and a clearance formed between the partition wall and the rotary shaft. Also, in case that a plurality of the through-holes is formed in the partition wall, the circulation path is configured by the hole of the hollow member, the through-hole in which the hollow member is not mounted and the clearance.

The liquid chambers communicating with the seal member accommodation chamber cause the pressure variation in case that this disclosure is applied to a pump apparatus. Due to the pressure variation, the oil flow is caused in the circulation path. The oil flow may be caused by compression and restoration of a seal member (rubber ring) resulting from the pressure variation of the liquid chambers, generation and disappearance of a suction force resulting from driving and stopping of the pump, rotation of the rotary shaft, axial movement (repeating movement in the axial direction) of the seal member and the like. According to the oil flow, the foreign materials and deteriorated oil are prevented from remaining in the seal member accommodation chamber.

Thereby, the degeneration of the seal member due to the deteriorated oil is suppressed, and the damage of the seal member due to the foreign materials is also suppressed.

Also, the hollow member engaged to the seal member serves as a rotation preventing key and thus prevent the seal member from rotating. Accordingly, the sliding of the shaft hole-side seal part (outer periphery of the rubber ring) of the seal member is suppressed and then the wearing or tearing of rubber due to the sliding are also suppressed, so that the durability of the seal member is improved. Also, the circulation path is formed, so that the removing of air in the seal member accommodation chamber is also promoted.

Meanwhile, in a pump apparatus where two sets of pumps having a phase difference of 180 degrees between a suction and a discharge are provided at both sides of the seal member accommodation chamber, the pressure is alternately increased and decreased in the liquid chamber of one pump and in the liquid chamber of the other pump. Thereby, both ends of the seal member are alternately applied with a force pushing and pulling the seal member in the axial direction, so that a pump operation is generated by the axial movement of the seal member due to the force. Accordingly, the oil circulation in the circulation path is further promoted.

Also, the hollow member is arranged at a position at which the opening of the hollow member overlaps with the upper side space of the seal member accommodation chamber in a vertical direction. Thereby, it is possible to sufficiently extract the air in the seal member accommodation chamber through the hole of the hollow member, which serves as an air removal passage.

Also, the partition wall is formed with a plurality of the through-holes and the hollow member is mounted in at least one of the through-holes. Thereby, it is possible to configure the circulation path in which the oil can flow more easily.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Hereinafter, an illustrative embodiment of a shaft seal device and a pump apparatus of this disclosure will be described with reference to FIGS. 1 to 5 of the accompanying drawings.

Figure 1:
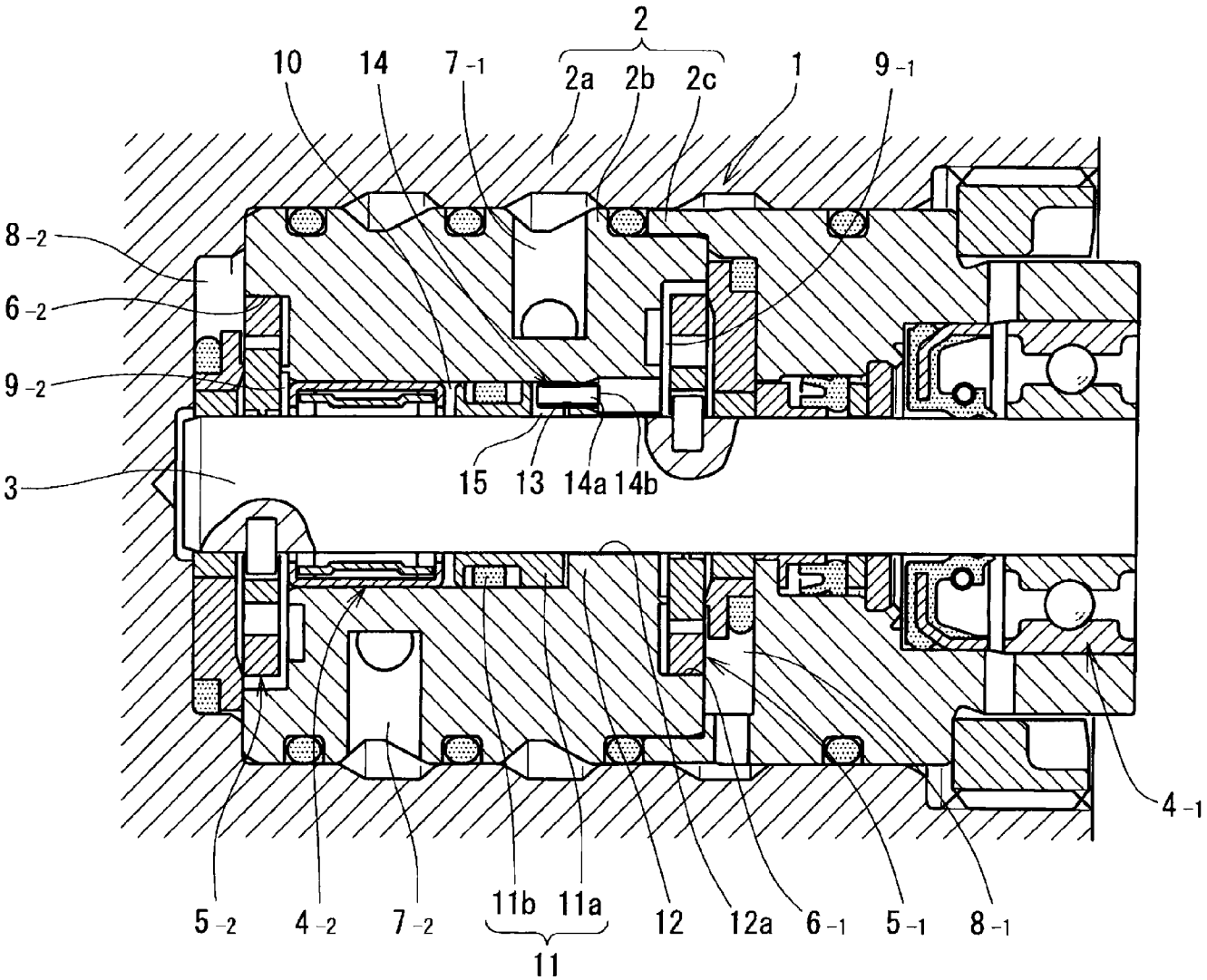
FIG. 1 is a sectional view illustrating an illustrative embodiment of a shaft seal device and a pump apparatus using the shaft seal device of this disclosure.

FIG. 1 illustrates an outline of an example of a pump apparatus 1. A reference numeral '2' of FIG. 1 indicates a housing of a fluid pressure unit for a brake apparatus having the pump apparatus 1 incorporated therein. The housing 2 has three members of an external housing 2*a* and internal housings 2*b*, 2*c* incorporated in the external housing 2*a* with being liquid-tightly sealed at outer diameter-sides.

A rotary shaft 3 is incorporated at centers of the internal housings 2*b*, 2*c*. The rotary shaft 3 is supported by bearings $\mathbf{4}_{-1}$, $\mathbf{4}_{-2}$ (hereinafter, reference symbols $_{-1}$ and $_{-2}$ are added for convenient distinction of the components) mounted to the internal housings 2*b*, 2*c* so that it can be rotated at a specific position. The rotary shaft 3 is coupled to an output shaft of a motor (not shown) and is rotated by power of the motor.

In the housing 2, two sets of pumps $\mathbf{5}_{-1}$, $\mathbf{5}_{-2}$ driven by the rotary shaft 3 are incorporated with an interval. The pumps $\mathbf{5}_{-1}$, $\mathbf{5}_{-2}$ are internal gear pumps, in which an inner rotor and an outer rotor having a difference of the numbers of teeth of 1 (one) are eccentrically arranged. The pumps $\mathbf{5}_{-1}$, $\mathbf{5}_{-2}$ are accommodated in pump accommodation chambers $\mathbf{6}_{-1}$, $\mathbf{6}_{-2}$ formed in the internal housings 2*b*, 2*c*.

The inner rotors of the pumps are rotated by the rotary shaft 3 and the outer rotors are correspondingly rotated, so that volumes of chambers formed between the teeth of the inner and outer rotors are increased and decreased. As the volumes of the chambers are increased and decreased, the liquid (brake fluid) is sucked and discharged. In the meantime, the pumps $\mathbf{5}_{-1}$, $\mathbf{5}_{-2}$ are arranged so that a phase difference of the suction and the discharge between the pumps is 180 degrees.

Reference numerals '$\mathbf{7}_{-1}$, $\mathbf{7}_{-2}$' of FIG. 1 indicate suction paths of the pumps and reference numerals '$\mathbf{8}_{-1}$, $\mathbf{8}_{-2}$' of FIG. 1 indicate discharge paths of the pumps. One end faces of the rotors of the respective pumps face liquid chambers (in the drawings, suction ports communicating with chambers of the respective pumps) $9_{-1}$, $9_{-2}$ respectively communicating with the suction paths $7_{-1}$, $7_{-2}$. The brake fluid is sucked from the liquid chambers $9_{-1}$, $9_{-2}$ to the chambers of the respective pumps.

A seal member accommodation chamber 10 is provided between the pumps $5_{-1}$, $5_{-2}$, and a seal member 11 that seals an outer periphery of the rotary shaft is accommodated in the seal member accommodation chamber 10.

A seal member 11 is configured by combining an annular piece 11*a*, which is slidably fitted onto the rotary shaft 3 and seals a gap between the rotary shaft 3 and the seal member, and a rubber ring 11*b*, which is received in an annular recess formed on an outer periphery of the annular piece. The annular piece 11*a* is formed of a resin having an excellent sliding characteristic and is prevented from rotating by a hollow member 14 provided to the housing 2.

The rubber ring 11*b* is arranged with a diametrical interference between a hole surface of a shaft hole formed in the housing and the annular piece 11*a* and thus seals between the shaft hole of the housing and the annular piece 11*a*.

The annular recess formed on the outer periphery of the annular piece 11*a* is a recess having an axial play between the recess and the rubber ring 11*b*, and the annular piece 11*b* and the rubber ring 11*b* can be relatively moved in the axial direction within a range of the axial play.

The bearing $4_{-2}$ is provided between the pump $5_{-2}$ and the seal member accommodation chamber 10. A left part of the seal member accommodation chamber 10 more than the seal member 11 in FIG. 1 communicates with the liquid chamber $9_{-2}$ of the pump $5_{-2}$ through an internal gap of the bearing $4_{-2}$.

On the other hand, the liquid chamber 9-1 of the pump 5-1 is partitioned from the seal member accommodation chamber 10 by a partition wall 12 arranged between the seal member accommodation chamber 10 and the liquid chamber 9-1. The partition wall 12 is formed with a shaft hole 12*a* and the rotary shaft 3 passes through the shaft hole 12*a*.

A clearance necessary for avoiding a contact of the rotary shaft is formed between the shaft hole 12*a* and the rotary shaft 3. According to the known pump apparatus, a portion, at which a right part of the seal member accommodation chamber 10 more than the seal member 11 in FIG. 1, communicating with the liquid chamber $9_{-1}$ of the pump $5_{-1}$ configured by only the clearance. Therefore, the lubricant or foreign materials could easily remain at the right part of the seal member accommodation chamber 10 more than the seal member 11 in FIG. 1.

In order to prevent such remaining, according to this disclosure, the partition wall 12 is formed with a through-hole 13 penetrating the partition wall in the axial direction and the hollow member (hollow pin) 14 is inserted into the through-hole 13. The seal member accommodation chamber 10 is provided to communicate with the liquid chamber $9_{-1}$ through a hole of the hollow member 14. Thereby, a circulation path of the brake fluid is formed between the seal member accommodation chamber 10 and the liquid chamber $9_{-1}$.

The circulation path of the pump apparatus of FIG. 1 is configured by a central hole 14*a* of the hollow member 14 and a clearance formed between a hole surface of the shaft hole 12*a* of the partition wall and the outer periphery of the rotary shaft 3. The circulation path is formed, so that the foreign materials and deteriorated brake fluid are prevented from remaining in the seal member accommodation chamber 10. Thereby, the lubrication and protection performance of the seal member is improved, and the durability of the shaft seal part is improved. Also, since the circulation path is formed, the air in the seal member accommodation chamber 10 can be removed.

Figure 2:
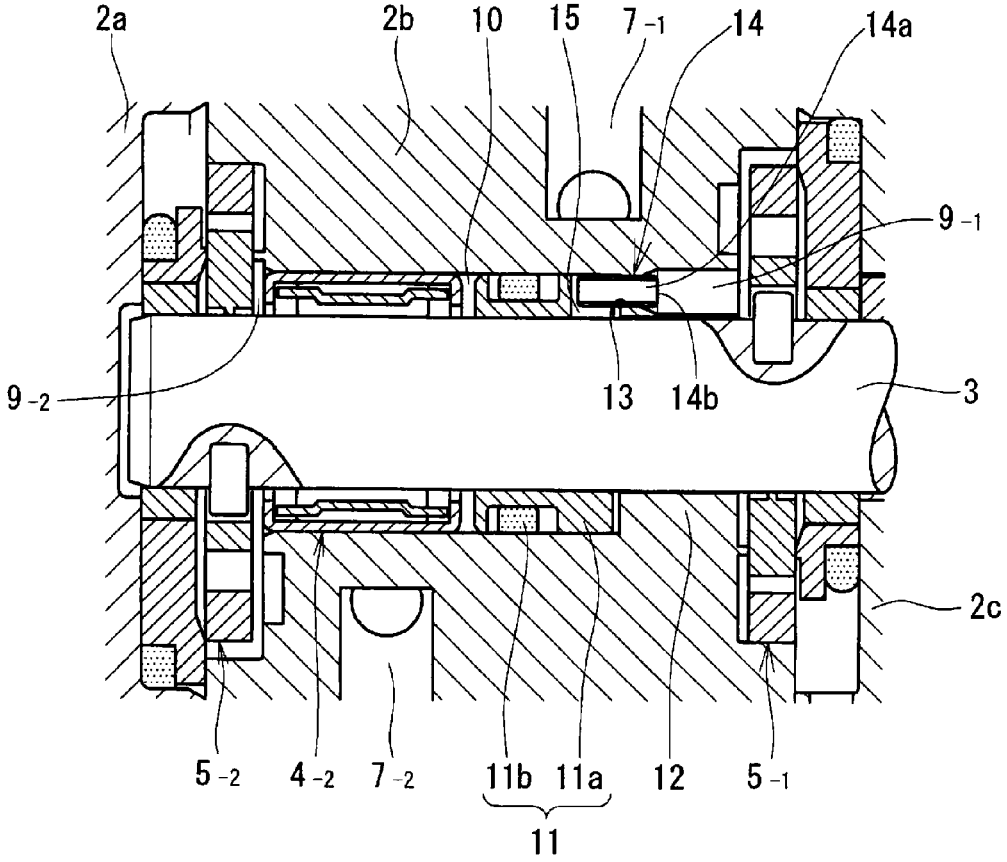
FIG. 2 is an enlarged sectional view of main parts of the pump apparatus shown in FIG. 1.
Figure 3:
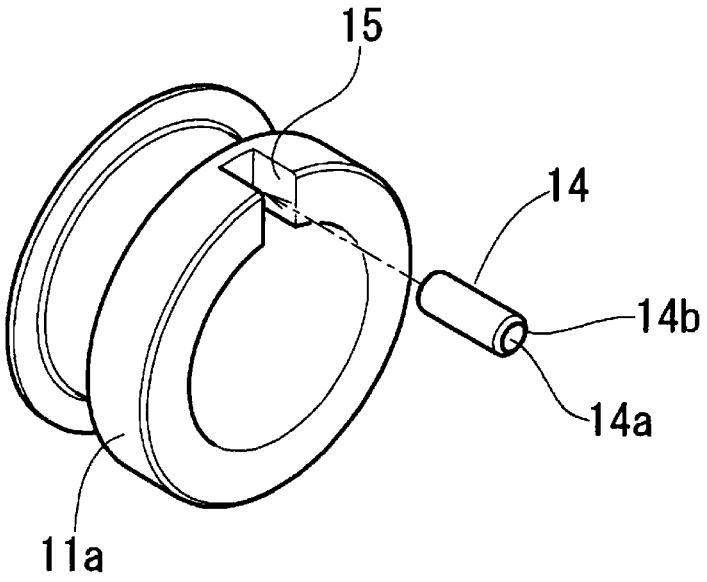
FIG. 3 illustrates a rotation preventing structure of a seal member.

With respect to avoiding of the air of the seal member accommodation chamber 10, as shown in FIG. 2, the hollow member 14 is preferably arranged at a position, at which an opening 14*b* of the central hole 14*a* overlaps with an upper surface-side (upper side than the central axis line of the rotary shaft 3) space of the seal member accommodation chamber 10 in a vertical direction. Accordingly, it is possible to sufficiently extract the air from the upper surface-side space of the seal member accommodation chamber 10, and thus it is possible to ship the pump apparatus, so that the air is completely removed.

Figure 4:
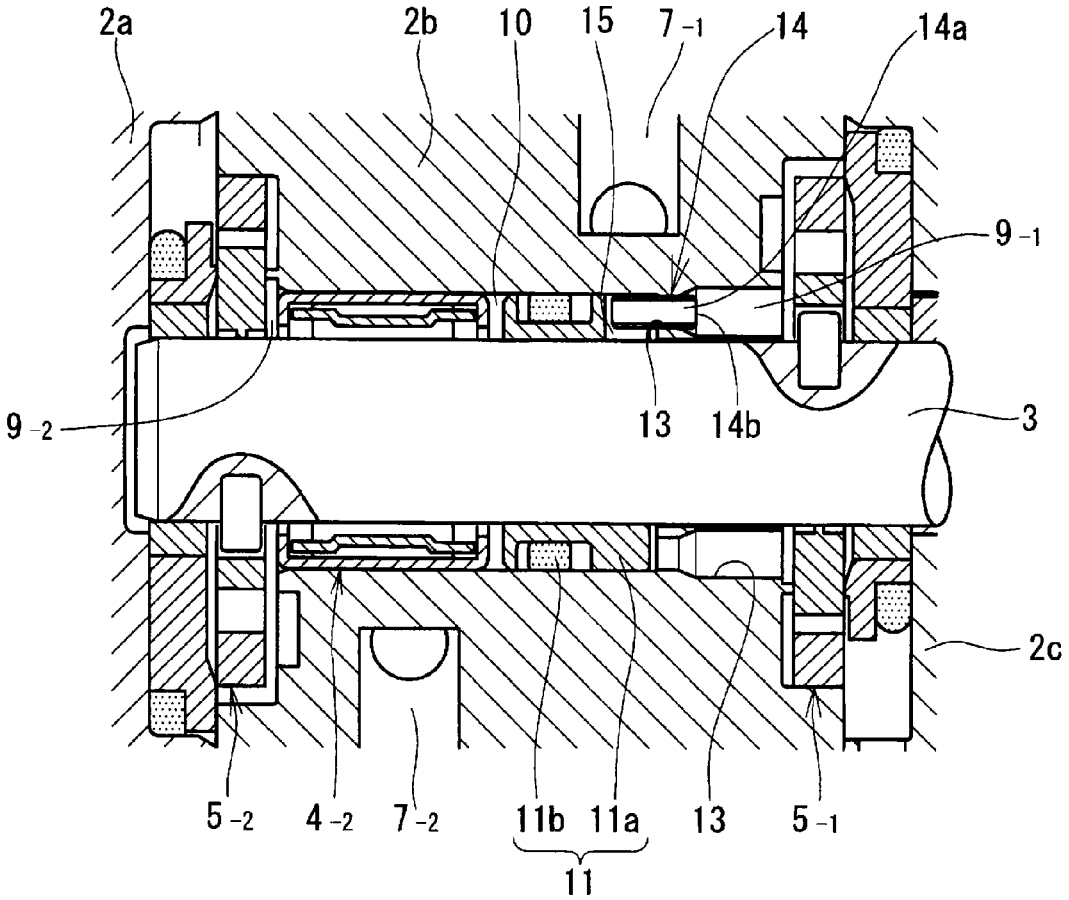
FIG. 4 is a sectional view of main parts illustrating an example where a partition wall is formed with a plurality of through-holes.

As shown in FIG. 4, the partition wall 12 may be formed with a plurality of the through-holes 13. When the plurality of through-holes 13 is formed, it is possible to form a circulation path between the seal member accommodation chamber 10 and the liquid chamber $9_{-1}$, so that the brake fluid can flow more easily.

The hollow member 14 is provided to serve as a rotation preventing key of the annular piece 11*a*. Therefore, only one hollow member 14 may be sufficient, even when the number of the through-holes 13 is provided. In case that the plurality of the through-holes 13 is provided, the through-hole in which the hollow member 14 is not mounted, is arranged at the position, at which it overlaps with the upper surface-side space of the seal member accommodation chamber 10 with respect to the height level, so that the effect of the air removal is to be improved.

Meanwhile, according to the pump apparatus of FIG. 1, the pressure variation is caused in the liquid chambers $9_{-1}$, $9_{-2}$ due to the operation and stopping of the pumps $5_{-1}$, $5_{-2}$. Since there is the phase difference of 180 degrees between the suction and the discharge in the pumps $5_{-1}$, $5_{-2}$, the pressure variation of the liquid chambers $9_{-1}$, $9_{-2}$ occurs in a manner that the pressure of one liquid chamber is increased and the pressure of the other liquid chamber is decreased. Thereby, both ends of the seal member 11 are alternately applied with forces pushing and pulling the seal member in the axial direction.

The annular piece 11*a* of the seal member 11 has smaller sliding resistance than the rubber ring 11*b* and also has an axial moving play. Therefore, the annular piece 11*a* is pushed and pulled by the force applied to both ends, so that it is axially advanced and retreated. Thereby, the volume of the side of the seal member accommodation chamber 10 communicating with the liquid chamber $9_{-1}$ is changed to generate a pump operation, so that the pump operation is caused and thus the oil circulation in the circulation path is promoted. Also, when the pumps $5_{-1}$, $5_{-2}$ operate, the pressures in the liquid chambers $9_{-1}$, $9_{-2}$ are changed, so that the rubber ring 11*b* is compressed and restored and thus it is possible to promote the oil circulation in the circulation path.

One end of the hollow member 14 protrudes into the seal member accommodation chamber 10. The protrusion part is inserted into a key recess 15 (refer to FIG. 3) formed in the annular piece 11*a*, so that the hollow member 14 is engaged into the annular piece 11*a*. Accordingly, the annular piece 11*a* is prevented from being pulled and rotated together with the rotary shaft 3.

Therefore, the rubber ring 11*b* is not to be pulled and slid, and thus the rubber ring 11*b* is not to be damaged due to the wearing or tearing. As a result, the durability of the seal member 11 is improved.

Figure 5:
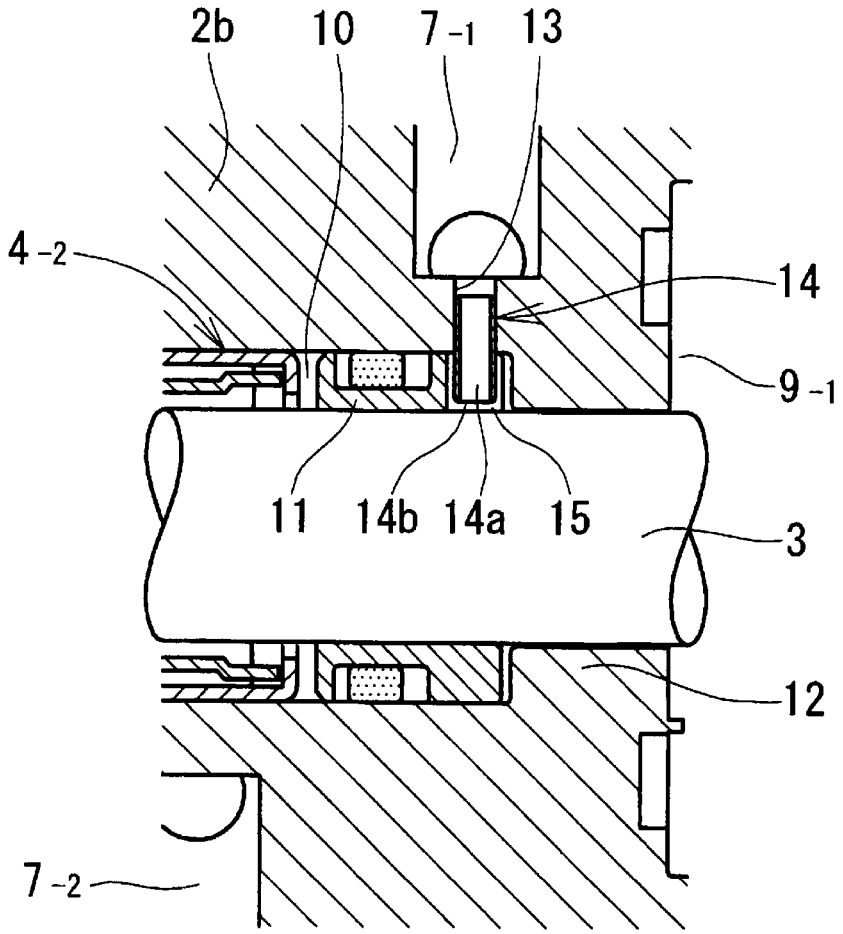
FIG. 5 is a sectional view of main parts illustrating an example where a hollow member is provided to penetrate the partition wall in a diametrical direction.

In the meantime, the through-hole 13, into which the hollow member 14 is mounted, is not limited to the axially extending type as described above. For example, as shown in FIG. 5, the through-hole 13 may be formed to diametrically extend, the hollow member 14 may be mounted in the through-hole, and the seal member 11 may be engaged with the protrusion part of the hollow member 14. In this case, for example, the through-hole 13 is formed to extend from an inner end portion of the diametrical extension part of the suction path $\mathbf{7}_{-1}$, which is formed in the partition wall 12 and communicates with the liquid chamber $\mathbf{9}_{-1}$, toward a diametrically inner side, and thus the suction path $\mathbf{7}_{-1}$ and the seal member accommodation chamber 10 communicates with each other through the hollow member 14 mounted in the through-hole 13. Even in this configuration, it is possible to obtain the same effects as the above. Also, since the hollow member 14 extends in the diametrical direction, it is possible to easily reduce the space in which the hollow member 14 is arranged, compared to the configuration where the hollow member extends in the axial direction. Thus, it is also possible to suppress the axial length of the pump apparatus 1. Additionally, in this example, the suction path $\mathbf{7}_{-1}$ functions as the liquid chamber.

Further, the shaft seal device of this disclosure can be also applied to a shaft seal part, not only the pump apparatus. The same effects of this disclosure can be achieved in an apparatus that has a liquid chamber, into which oil to be used as the lubricant is introduced, and a partition wall, which is provided on an outer periphery of a rotary shaft to partition the liquid chamber and a seal member accommodation chamber between both chambers, and a chamber, which faces the partition wall of the seal member accommodation chamber sealed by the partition wall.

The pump apparatus to which this disclosure is applied is not limited to the exemplified internal gear pump. The rotary pump driven by power transferred via the rotary shaft includes an external gear pump, a vane pump, an impeller pump and the like, and it will be effective in the shaft seal parts of such pump apparatuses.

What is claimed is:

1. A shaft seal device comprising:

a rotary shaft;

a seal member arranged on an outer periphery of the rotary shaft;

a liquid chamber filled with oil; and a seal member accommodation chamber that accommodates the seal member therein, wherein the liquid chamber and the seal member accommodation chamber are separated by a partition wall, wherein the rotary shaft passes through a shaft hole formed in the partition wall, wherein the seal member includes an annular piece which seals a gap between the outer periphery of the rotary shaft and the partition wall, wherein the annular piece has a recess, in the axial direction, at a part of a circumferential portion, wherein the partition wall includes a through-hole, a hollow member having a circumference smaller than a circumference of the rotary shaft is positioned in the through-hole while being spaced apart from the rotary shaft, and the hollow member includes a protruding portion that protrudes toward the seal member accommodation chamber and is engaged into the recess, and wherein the liquid chamber and the seal member accommodation chamber communicate with each other through the hollow member.

2. A rotary pump apparatus comprising:

a rotary pump that pumps liquid;

a rotary shaft that drives the rotary pump; and a seal member arranged on an outer periphery of the rotary shaft;

wherein the seal member is accommodated in a seal member accommodation chamber formed at the outer periphery of the rotary shaft, wherein a liquid chamber connected to a chamber of the rotary pump and the seal member accommodation chamber are separated by a partition wall, wherein the seal member includes an annular piece which seals a gap between the outer periphery of the rotary shaft and the partition wall, wherein the annular piece has a recess, in the axial direction, at a part of a circumferential portion, wherein the rotary shaft passes through a shaft hole formed in the partition wall, wherein the partition wall includes a through-hole penetrating the partition wall, a hollow member having a circumference smaller than a circumference of the rotary shaft is positioned in the through-hole while being spaced apart from the rotary shaft, and the hollow member includes a protruding portion that protrudes toward the seal member accommodation chamber and is engaged with the recess, and wherein the liquid chamber and the seal member accommodation chamber communicate with each other through the hollow member.

3. The rotary pump apparatus according to claim 2, wherein the seal member accommodation chamber possesses two axial ends, the rotary pump being provided on one side of one of the two axial ends, a second rotary pump being provided on an other side of other of the two axial ends, wherein the rotary pump and the second rotary pump driven by the rotary shaft are provided at the two axial ends of the seal member accommodation chamber so that a phase difference of a suction and a discharge between the pumps is 180 degrees, wherein the seal member is axially movable in the seal member accommodation chamber in a direction extending along the rotary shaft, the two axial ends of the seal member accommodation chamber partitioned by the seal member respectively communicate with two of the liquid chambers that are connected to a respective chamber provided at the rotary pump and the second rotary pump, and wherein the partition wall is arranged between the liquid chamber and the seal member accommodation chamber, and the hollow member is disposed at the partition wall.

4. The rotary pump apparatus according to claim 3, wherein one of the liquid chamber and the seal member accommodation chamber communicate with each other through a bearing provided therebetween.

5. The rotary pump apparatus according to claim 2, wherein the hollow member is arranged at a position at which an opening of the hollow member overlaps with an upper side space of the seal member accommodation chamber in a direction transverse to an axial direction extending along the rotary shaft.

6. The rotary pump apparatus according to claim 2, wherein the partition wall includes a plurality of the through-holes and the hollow member is mounted in at least one of the plurality of the through-holes.

7. A shaft seal device comprising:

a rotary shaft possessing an outer periphery;

a seal member arranged on an outer periphery of the rotary shaft;

a liquid chamber;

a seal member accommodation chamber that accommodates the seal member;

the liquid chamber and the seal member accommodation chamber being separated from each other by a partition wall, the partition wall including a shaft hole passing through the partition wall;

the rotary shaft passing through the shaft hole in the partition wall and the outer periphery of the rotary shaft being sealed by the seal member;

the partition wall possessing a through-hole;

a pin having a circumference smaller than a circumference of the rotary shaft positioned in the through-hole of the partition wall while being spaced apart from the rotary shaft, the pin possessing a through-hole that communicates with both the liquid chamber and the seal member accommodation chamber;

the pin possessing a protruding part protruding from the through-hole of the partition wall and towards the seal member accommodation chamber;

wherein the protruding part engages a key recess provided on the seal member; and wherein the liquid chamber and the seal member accommodation chamber communicate with each other through the through-hole of the pin.

8. The rotary pump apparatus according to claim 7, wherein the seal member accommodation chamber possesses two axial ends, the rotary pump being provided on one axial end side of the seal member accommodation chamber, a second rotary pump being provided on the other axial end side of the seal member accommodation chamber, wherein the rotary pump and the second rotary pump driven by the rotary shaft are provided at the two axial ends of the seal member accommodation chamber so that a phase difference of a suction and a discharge between the pumps is 180 degrees, wherein the seal member is axially movable in the seal member accommodation chamber in a direction extending along the rotary shaft, wherein the two axial ends of the seal member accommodation chamber partitioned by the seal member respectively communicate with two of the liquid chambers that are connected to a respective chamber provided at the rotary pump and the second rotary pump, and wherein the partition wall is arranged between the liquid chamber and the seal member accommodation chamber, and the pin is disposed at the partition wall.

9. The rotary pump apparatus according to claim 8, wherein one of the liquid chamber and the seal member accommodation chamber communicate with each other through a bearing provided therebetween.

10. The rotary pump apparatus according to claim 7, wherein the pin is arranged at a position at which an opening of the through-hole of the pin overlaps with an upper side space of the seal member accommodation chamber in a direction transverse to an axial direction extending along the rotary shaft.

11. The rotary pump apparatus according to claim 7, wherein the partition wall includes a plurality of the through-holes and the pin is disposed in at least one of the plurality of the through-holes.

* * * * *